US006792998B2

(12) United States Patent
David

(10) Patent No.: US 6,792,998 B2
(45) Date of Patent: Sep. 21, 2004

(54) AUTOMATICALLY RESETTABLE GUIDE SYSTEM FOR AN OVERHEAD DOOR

(76) Inventor: Kenneth David, 247 Ave. H, St. Louis, MO (US) 63125

( * ) Notice: Subject to any disclaimer, the term of this patent is extended or adjusted under 35 U.S.C. 154(b) by 0 days.

(21) Appl. No.: 10/102,316

(22) Filed: Mar. 21, 2002

(65) Prior Publication Data

US 2003/0178159 A1 Sep. 25, 2003

(51) Int. Cl.[7] ..... E05D 15/00
(52) U.S. Cl. ..... 160/201; 16/DIG. 1
(58) Field of Search ..... 160/201, 265, 160/207, 273.1, 280, 281; 16/DIG. 1, 87 R, 91, 106, 97, 229

(56) References Cited

U.S. PATENT DOCUMENTS 5,535,805 A * 7/1996 Kellogg et al. ..... 160/201
5,601,133 A * 2/1997 Krupke et al. ..... 160/265
5,638,883 A * 6/1997 Schulte ..... 160/271
5,927,368 A * 7/1999 Rohrer et al. ..... 160/201
6,039,106 A * 3/2000 Gontarski et al. ..... 160/201
6,119,307 A * 9/2000 Weishar et al. ..... 160/201

* cited by examiner

*Primary Examiner*—David Purol
(74) *Attorney, Agent, or Firm*—Henry W. Cummings

(57) ABSTRACT

The present invention is a device which is designed to allow a door to give way when impacted by an outside force such as a forklift, reducing damage. The present invention requires less force to be activated, which allows its use on wider doors than were previously possible. The present invention is also able to reset itself, depending upon how much distance was traveled during the impact. The present invention requires less maintenance than other devices currently in use.

15 Claims, 8 Drawing Sheets

AUTOMATICALLY RESETTABLE GUIDE SYSTEM FOR AN OVERHEAD DOOR

I. FIELD OF THE INVENTION

This invention relates to a guide system mounted on an overhead door, specifically an overhead door which is guided along a predetermined path by a pair of tracks, and is able to be disengaged from one or both tracks when acted upon by an outside force. Once the outside force is removed, the door is able to automatically reset itself into the tracks. This ability to be disengaged will greatly reduce the possibility of damage to the overhead door other components of the installation.

II. BACKGROUND OF THE INVENTION

During the course of daily activity around a loading dock or other industrial location, an overhead door may be impacted by a truck, forklift, or other forceful means. If the door is not able to move with this impact, damage to the door, tracks, or other objects will result. Various means have been used to allow a door to move out of its tracks to avoid such damage.

For example, U.S. Pat. No. 5,535,805 discloses an overhead door system in which a spring loaded pin retracts into a housing when the door is impacted. The pin is forced into its housing by means of a track whose cross section employs a slanted ramp. There are several disadvantages in this system. One disadvantage is that it is necessary to use a track with a ramped cross section. This limits the choice of door tracks, and any deformity in the ramped cross section will hinder proper operation. Another disadvantage is that the pin and its associated components must be kept lubricated and free of corrosion for it to work properly. Yet another disadvantage is that this system is limited to use on doors which are no wider than 16 feet. If a wider door is impacted, it is likely that the door will buckle before there is adequate force applied at the ends of the door to move the spring loaded pin up the ramp, unless the door is heavily reinforced.

III. SUMMARY OF THE INVENTION

A. Objects of the Invention

One object of the present invention is to provide a means to protect doors and their associated components from extensive damage resulting from an impact by an outside force.

Another object of the present invention is to provide a means for the protection device to automatically reset once the outside force is removed.

Another object of the present invention is to provide a means to protect very wide doors.

Another object of the present invention is to provide means to install this system on existing doors with a variety of track styles.

B. Summary

The present invention is a device which is designed to allow a door to give way when impacted by an outside force such as a forklift, reducing damage. The present invention requires less force to be activated, which allows its use on wider doors than were previously possible. The present invention is also able to reset itself, depending upon how much distance was traveled during the impact. The present invention requires less maintenance than other devices currently in use.

IV. THE DRAWINGS

V. DESCRIPTION OF PREFERRED EMBODIMENTS

Figure 1:
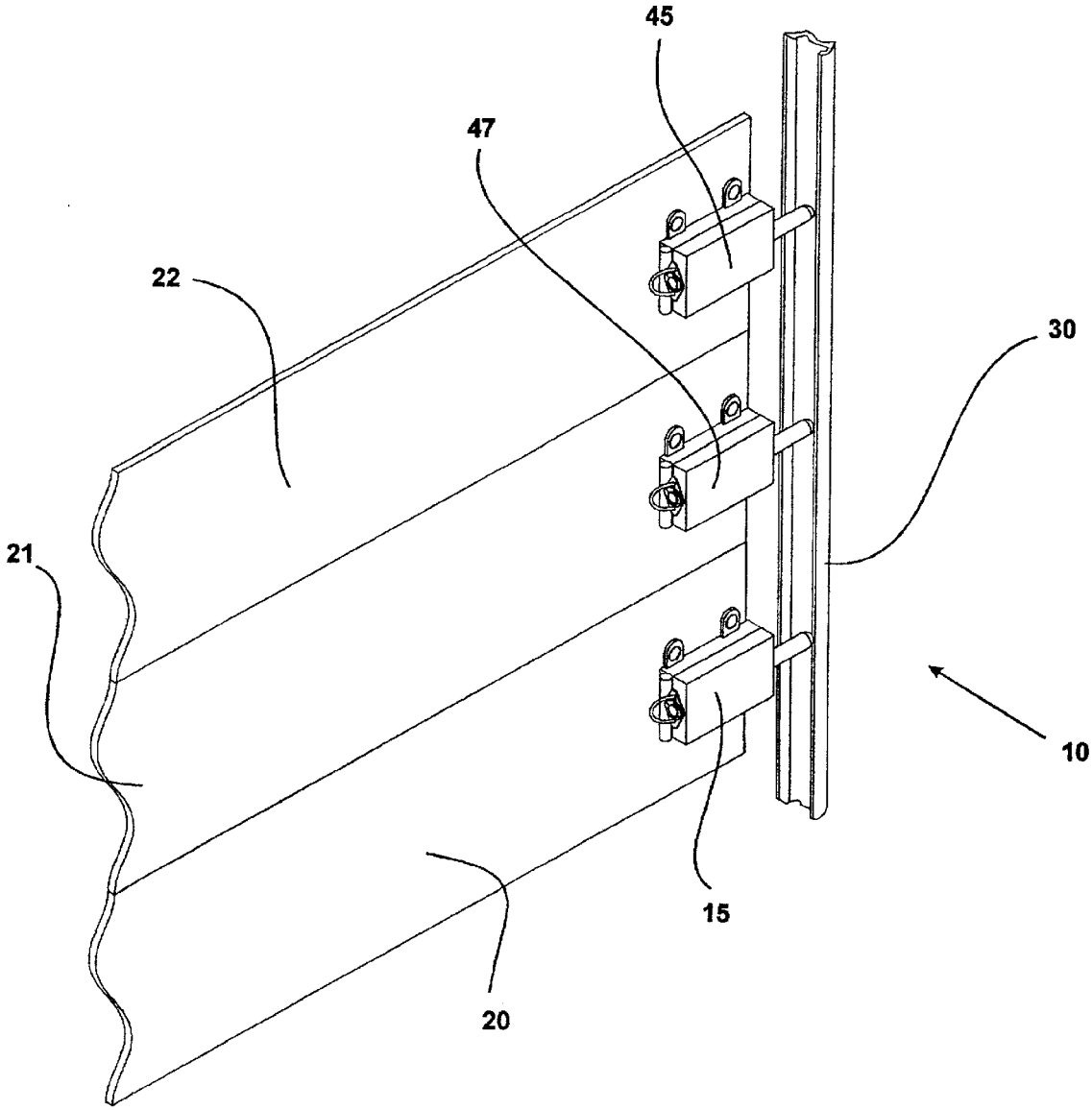
FIG. 1 is a perspective view of a typical installation.
Figure 2A:
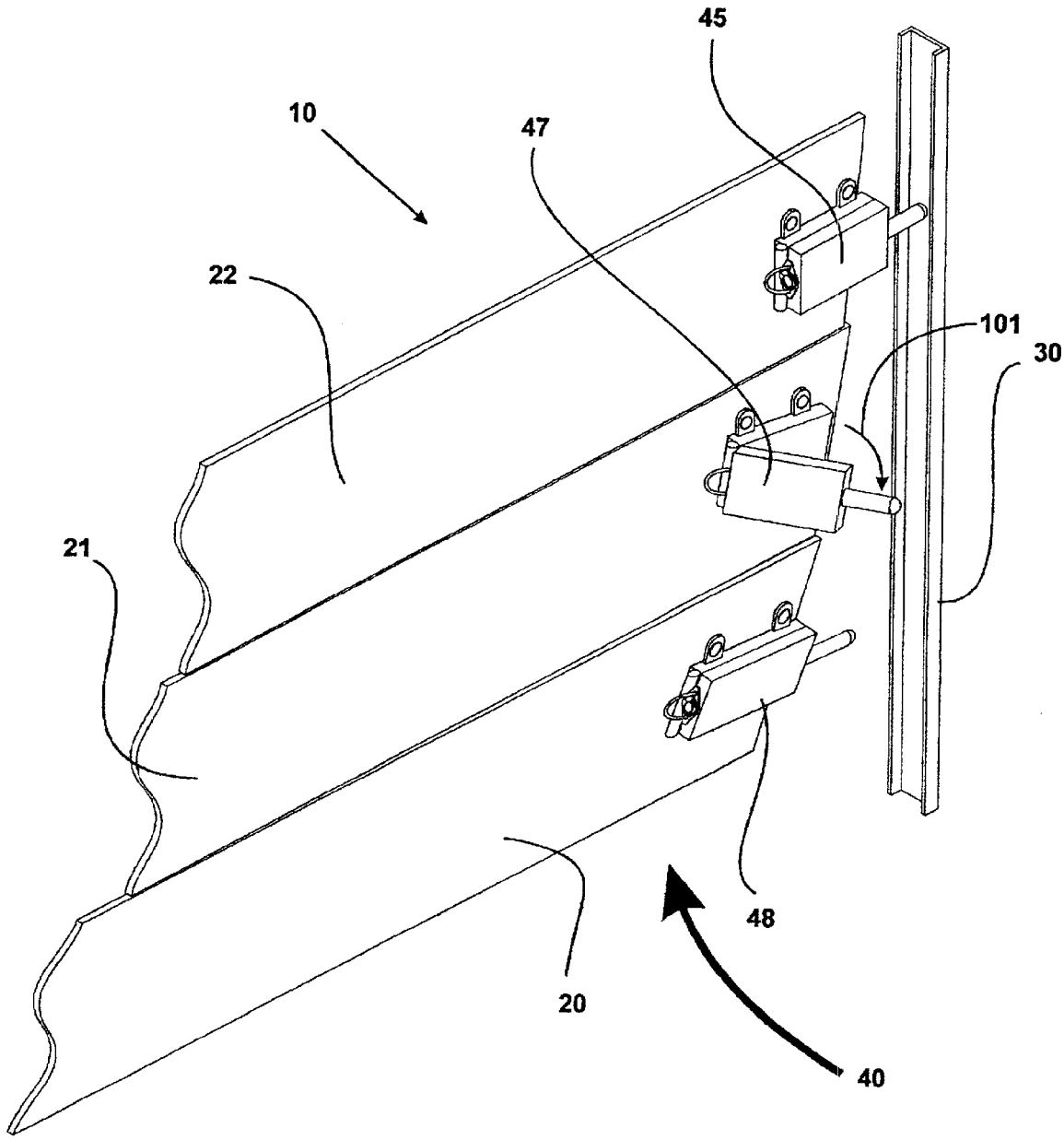
FIG. 2A is a perspective view of a typical installation after being impacted by an outside force.

In accordance with the present invention, guide system 15 is shown in a typical installation 10 in FIG. 1. Each guide system 15 is mounted to the ends of door segments 20, 21, 22 (only one end is shown for clarity). Guide systems 15 ride in track 30 when the door moves up or down during normal operation. FIG. 2A shows installation 10 after it has been impacted by an outside force (such as a forklift). The door segment 22 to which guide system 45 is mounted has not been moved far enough to activate guide system 45. The door segment 21 to which guide system 47 is mounted has been pushed out far enough that guide system 45 has been opened in arcuate movement 101, but still riding in track 30. The door segment 20 to which guide system 48 is mounted has been pushed out far enough that guide system 48 has once again closed, but is no longer riding in track 30.

Figure 2B:
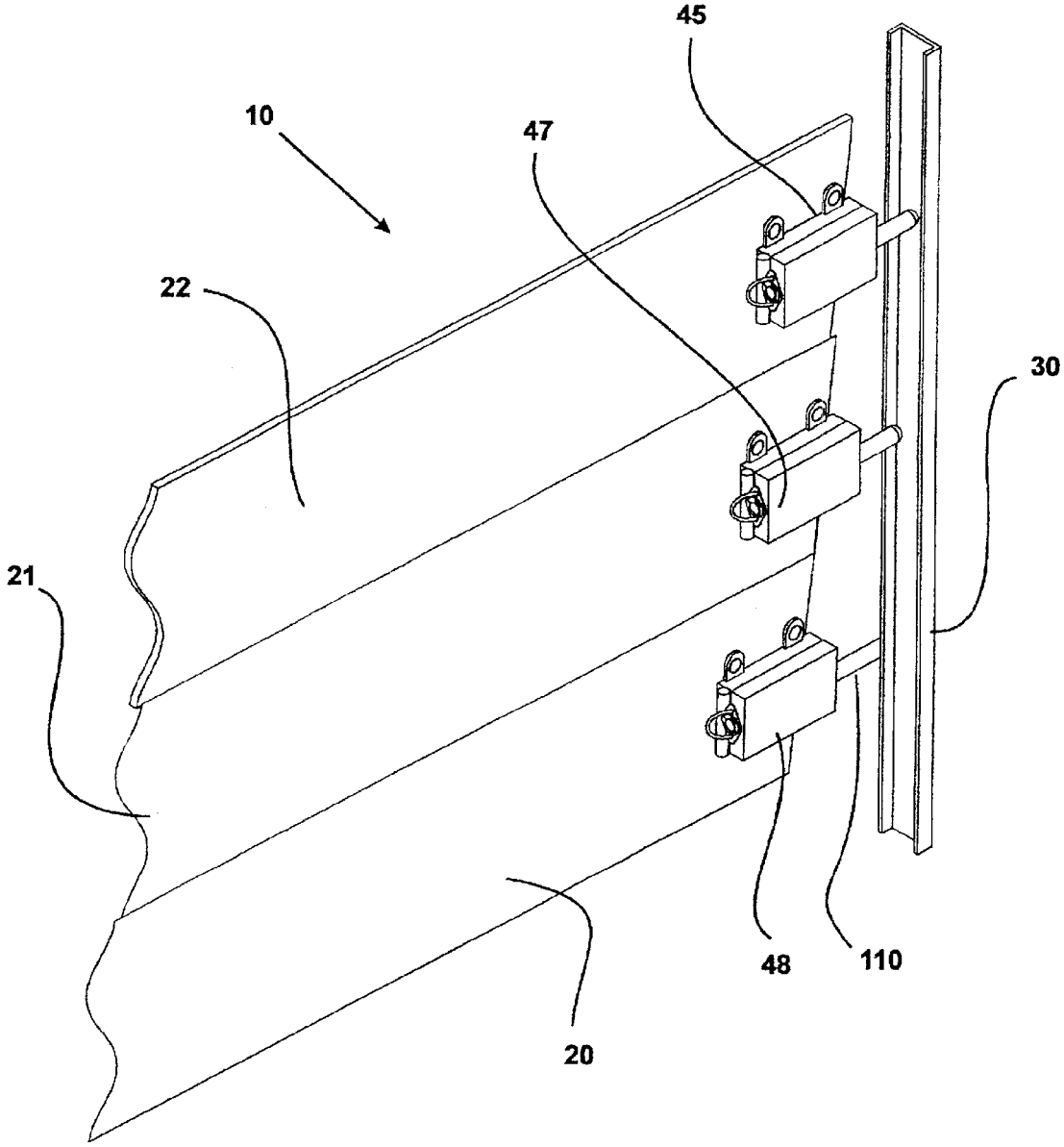
FIG. 2B is a perspective view of a typical installation after an outside force has been removed.

FIG. 2B shows installation 10 after the outside force has been removed. The door segment 22 to which guide system 45 is mounted is still in track 30. The door segment 21 to which guide system 47 is mounted has automatically reset itself so that guide system 45 is closed and again riding in track 30. The door segment 20 to which guide system 48 is mounted was pushed out so far that guide system 48 closed, and now pin 110 is bearing against the outside of track 30. It will need to be manually reset as is described hereinafter.

Figure 3A:
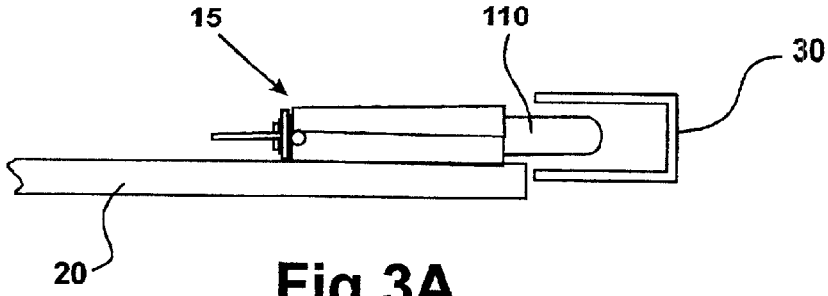
FIG. 3A is a top view of the present invention in normal use.
Figure 3B:
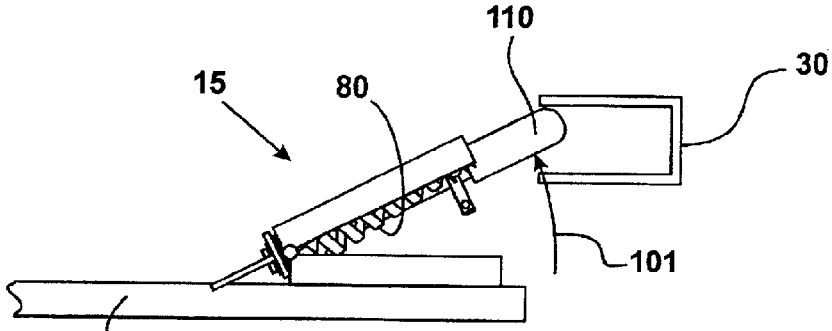
FIG. 3B is a top view of the present invention after impact by an outside force.

FIGS. 3A through 3E show top views of the sequence described above. FIG. 3A shows guide system 15 mounted to door segment 20. Pin 110 is in its normal position inside track 30. FIG. 3B shows the condition which exists after door segment 20 was impacted by an outside force (the outside force is still in place), causing guide system to open in an arcuate movement 101.

Figure 3C:
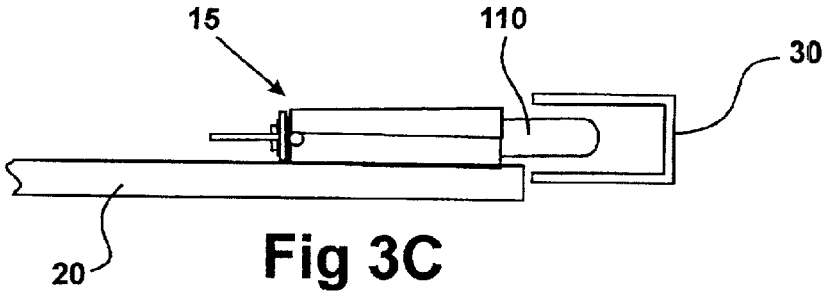
FIG. 3C is a top view of the present invention after the outside force has been removed and it has automatically reset.

In this instance, door segment 20 was not moved so far out as to force pin 110 out of track 30. Guide system 15 is open, but pin 110 is still inside track 30. Tension spring 80 is stretched, exerting force on the segments of guide system 15 to help it remain in position. FIG. 3C shows the condition which exists after the outside force has been removed. Due to the force exerted by tension spring 80, guide system 15 is once again closed and pin 110 is in its normal position inside track 30.

Figure 3D:
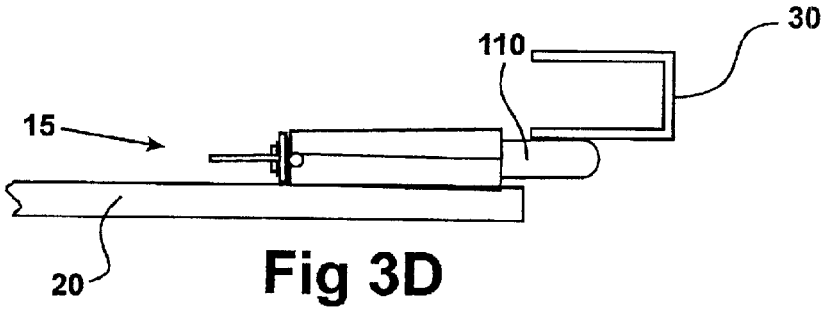
FIG. 3D is a top view of the present invention after the outside force has been removed, but has moved too far to automatically reset.
Figure 3E:
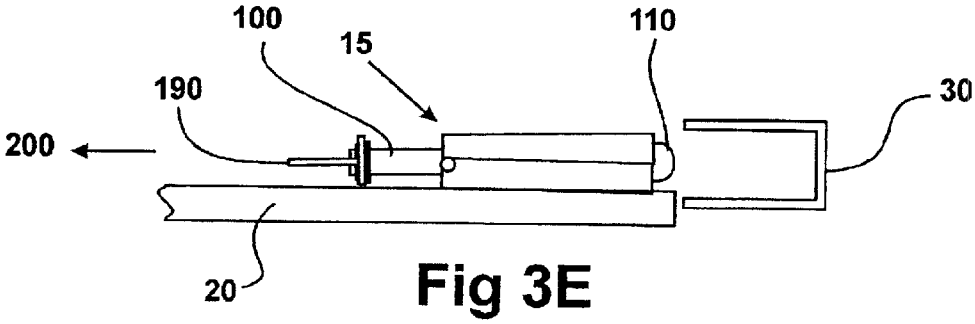
FIG. 3E is a top view of the present invention being manually reset.
Figure 4A:
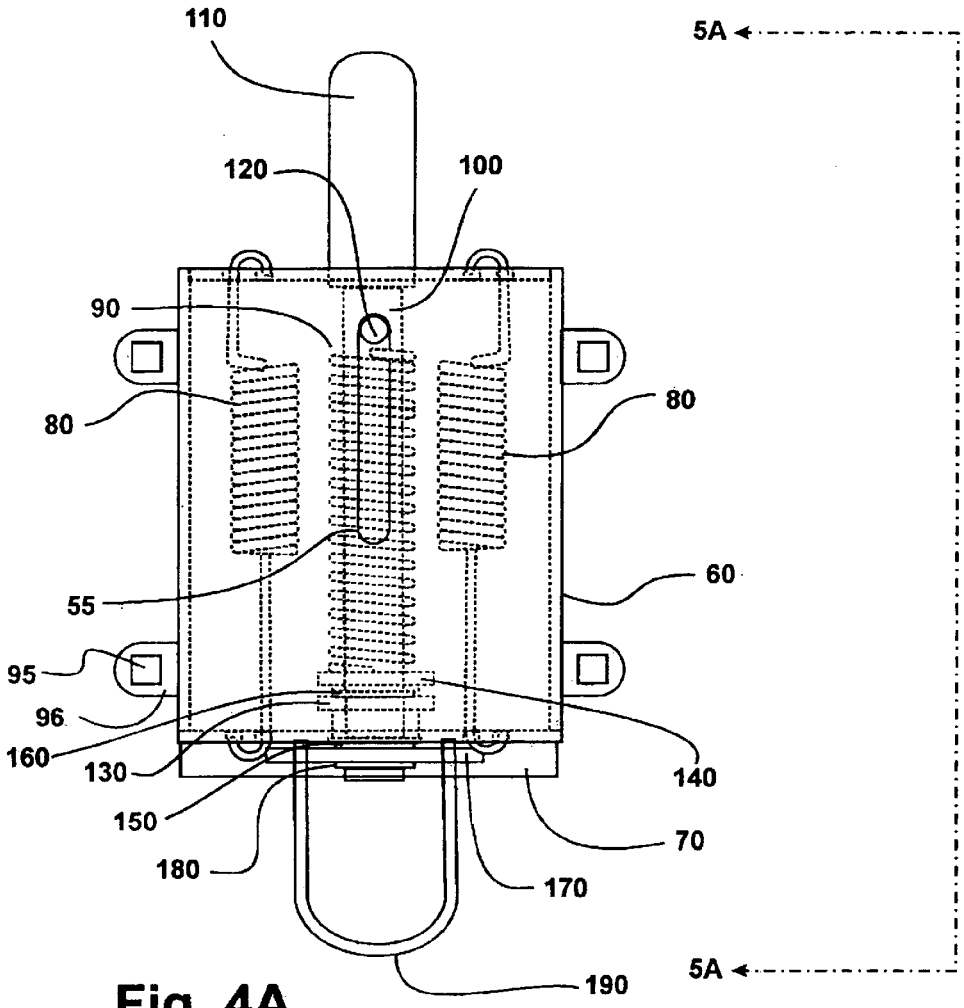
FIG. 4A is a view of the guide system showing its internal components.
Figure 4B:
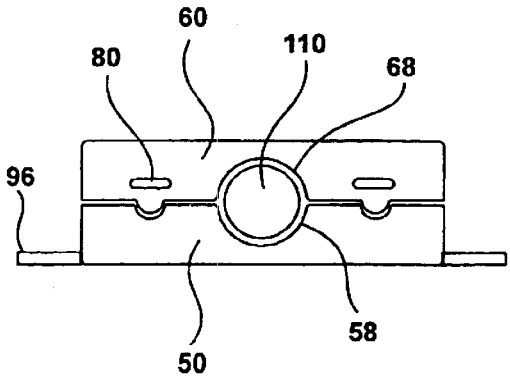
FIG. 4B is an end view of the guide system.

FIG. 3D shows the condition which exists after the outside force has been removed. In this instance, door segment 20 was moved far enough out to force pin 110 out of track 30. Due to the force exerted by tension spring 80, guide system 15 is once again closed, but pin 110 is now bearing on the outside of track 30. FIG. 3E shows guide system 15 being manually reset. Handle 190 is pulled in direction 200, which retracts shaft 100 and pin 110 away from track 30, allowing door segment 20 to be once again moved into its proper position. When handle 190 is released, shaft 100 and pin 110 return to their original positions, as shown in FIG. 3A.

Figure 5A:
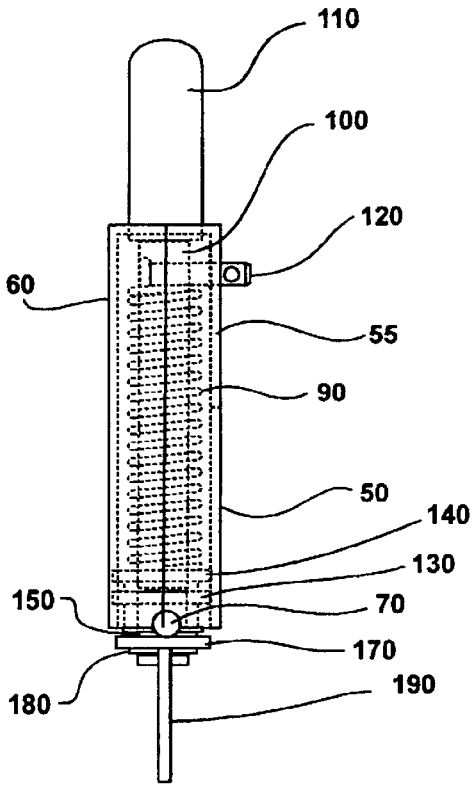
FIG. 5A is a side view of the guide system in its normal (closed) position.
Figure 5B:
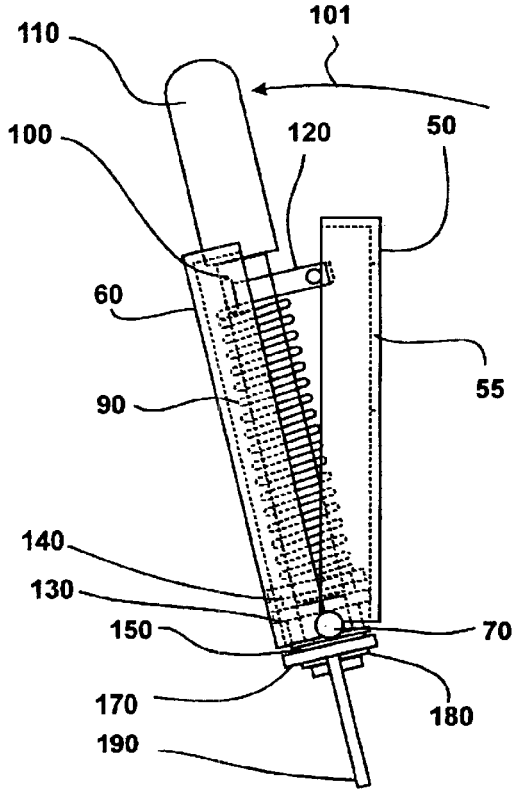
FIG. 5B is a side view of the guide system in its activated (open) position.

FIGS. 4A through 5B show the guide system and its internal components. Guide system 15 comprises a fixed housing 50 and a moveable housing 60. Fixed housing 50 is mounted to door segment 20, 21, 22 by means of mounting lugs 96 and holes 95. Hinge 70 allows moveable housing 60 to swing open and closed in an arcuate movement (FIG. 5B). Moveable housing 60 is held closed to fixed housing 50 by means of tension springs 80. One end of each tension spring 80 is attached to fixed housing 50; the other end of tension spring 80 is attached to moveable housing 60. This provides a very strong means to keep the two housings closed with respect to one another, keeping door segment 20 in proper alignment with track 30 during normal operation.

The action of tension springs 80 which keep the two housings closed with respect to one another facilitate the automatic reset of guide system 15 as previously described.

Pin 110 rides in track 30, and may be made of nylon, teflon, or other material that provides preferably inherent lubrication for ease of operation and long life. Pin 110 is mounted to shaft 100. Shaft 100 protrudes through the end of moveable housing 60, and is free to slide back and forth, guided by guide pin assembly 120 which rides in slot 55. The normal position of shaft 100 is maintained by compression spring 90, which bears against bushing 140 and guide pin assembly 120. Bushings 140, 130 provide means for shaft 100 to move back and forth while reducing wear. Washer 150 provides a space between moveable housing 60 and lug 170. The entire assembly is retained by retaining rings 160, 180. Handle 190 provides means for a user to retract shaft 100.

Figure 6A:
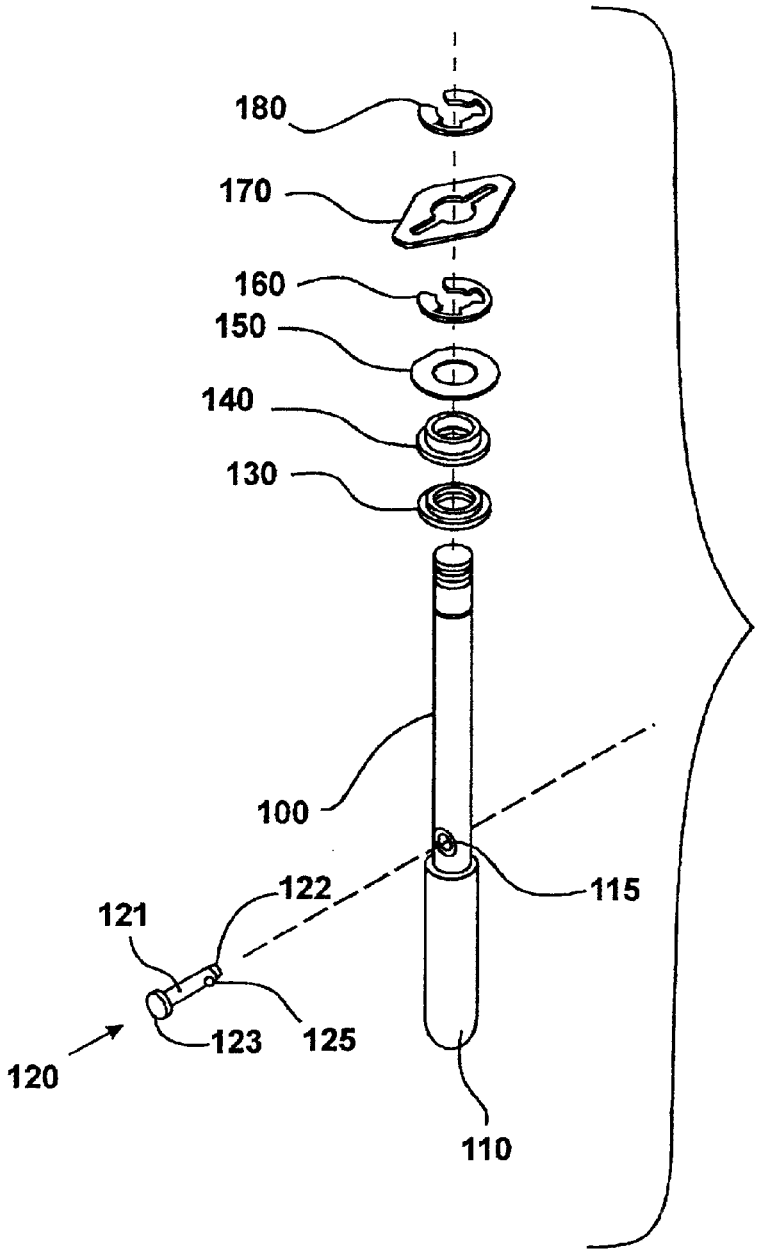
FIG. 6A is an exploded view of some internal components of the guide system mounted to shaft 100.
Figure 6B:
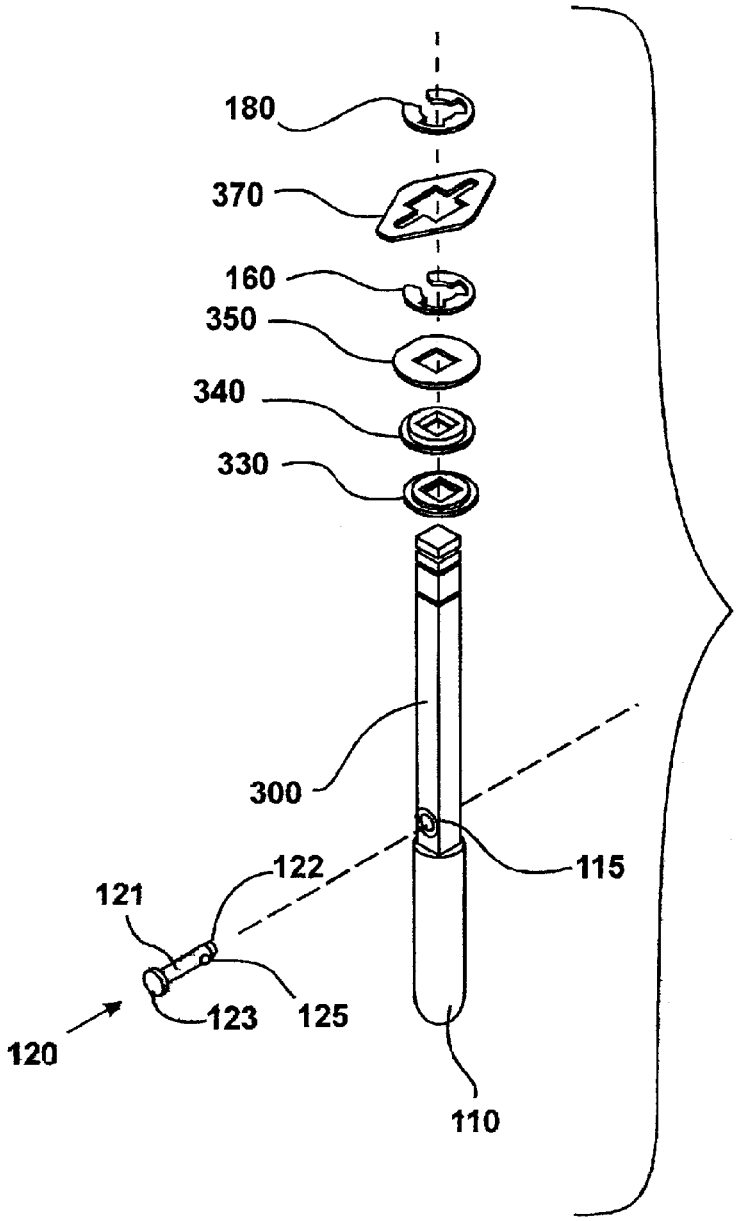
FIG. 6B is an exploded view of some internal components of the guide system mounted to shaft 300.

Guide pin assembly 120 as shown in FIGS. 6A and 6B comprises body 121, beveled end 122, head 123, and ball 125. Guide pin assembly 120 is permanently mounted to shaft 100 (FIG. 6A) or 300 (FIG. 6B) via hole 115 by means of welding, bonding, or staking. Guide pin assembly 120 provides means to keep moveable housing 60 and fixed housing 50 together. When in the closed position as shown in FIG. 5A, ball 125 in the end of guide pin assembly 120 is outside of fixed housing 50. When moveable housing 60 starts to open, ball 125 resists due to its interference fit with slot 55. When sufficient force is imposed, ball 125 retracts into body 121, allowing guide pin assembly 120 to pull free of slot 55. Conversely, when moveable housing 60 is allowed to close, tension springs 80 pull moveable housing 60 forcefully against fixed housing 50.

Beveled end 122 of guide pin assembly 120 aids in locating guide pin assembly 120 into slot 55. Once ball 125 passes through slot 55, it interferes against fixed housing 50 to keep moveable housing 60 closed.

FIG. 6A shows a round shaft 100; FIG. 6B shows a square shaft 300. The components shown are designed to fit the appropriate shaft, and include retaining rings 160, 180, lug 170, 370, washer 150, 350, and bushings 140, 340, 130, 330. Operation of either style of shaft is identical, with the additional feature that square shaft 300 will not rotate.

In the event the door is impacted by an outside force (such as a forklift), it is pushed out in direction 40 (FIG. 2A). This outward force bears against pin 110 and shaft 100, which in turn bear against moveable housing 60. When sufficient force is attained, moveable housing 60 swings free of fixed housing 50, permitting door segment 21 to move. When the outside force is removed, the door falls back into its original position due to gravity. If door segment 21 did not move too far (as shown by open guide system 47, FIG. 2A), pin 110 is still riding in track 30. Therefore, moveable housing 60 is still able to close due to the force of tension springs 80.

If door segment 20 moved so far as to cause pin 110 to come out of track 30 (as shown by closed guide system 48, FIG. 2A), moveable housing 60 closes due to the force of tension springs 80. When the door is allowed to fall back to its original position, the pin 110 associated with closed guide system 48 is bearing on the outside of track 30 instead of its normal position inside track 30 (FIG. 2B). When this occurs, the user pulls on handle 190, which causes shaft 100 to retract inside moveable housing 60 against compression spring 90. When shaft 100 retracts sufficiently, pin 110 no longer bears on the outside of track 30, and door segment 20 can move back to its normal position.

The user releases handle 190, allowing compression spring 90 to force shaft 100 back into its normal position, and pin 110 is now back inside track 30.

What is claimed is:

1. A guide system which may be applied to an existing door and track including means to guide said door during its normal operation and means to protect said overhead door in the event of an impact comprising:

a fixed housing, a moveable housing, first resilient means biased to keep said fixed and said moveable housings closed, at least one projecting pin adapted to engage said track, at least one shaft, means to retain said shaft, second resilient means biased for automatically resetting said guide system; and means for manually resetting said guide system.

2. A guide system according to claim 1 wherein said fixed housing is adapted to be mounted to a segment of said overhead door.

3. A guide system according to claim 1 wherein said movable housing is attached to said fixed housing by hinge fastening means.

4. A guide system according to claim 1 having means to keep said fixed and movable housings closed relative to each other.

5. A guide system according to claim 4 wherein said means means to keep said fixed and moveable housings closed relative to each other comprise at least one guide pin.

6. A guide system according to claim 1 wherein said projecting pin is made of a relatively soft and slideable material which allows said projecting pin to move freely inside door tracks.

7. A guide system according to claim 6 wherein said relatively soft and slideable material is selected from nylon and teflon.

8. A guide system according to claim 1 wherein said shaft which moves inside said moveable housing, and allows said projecting pin to be manually reset into said tracks in the event the door is forced outward.

9. A guide system according to claim 1 wherein said means to retain said shaft bushings, a washer, and a retaining ring.

10. A guide system according to claim 1 wherein said second resilient means biased for automatic resetting said guide system comprise tension springs which allow said moveable housing to close with respect to said fixed housing.

11. A guide system according to claim 1 wherein said means for manually resetting said guide system include resetting means to manually reset the guide system if said pin no longer rides in said door track.

12. A guide system according to claim 11 wherein said manual resetting means comprise a handle which allows the user to pull said shaft into said moveable housing sufficiently far to allow said pin to once again ride in the door track.

13. A door system comprising:

a guide system, and tracks for said guide system;

said guide system comprising:

a fixed housing, a moveable housing, resilient means biased to keep said fixed and said moveable housings closed, at least one projecting pin, at least one shaft, means to retain said shaft, means for automatically resetting said guide system; and means for manually resetting said guide system.

14. A door system according to claim 13 wherein said track is sufficiently deep to accept said projecting pin.

15. A door system according to claim 13 wherein said means to retain said shaft comprise at least one bushing, at least one washer, and at least one retaining ring.

* * * * *